US008055169B2

(12) United States Patent
Ebe

(10) Patent No.: US 8,055,169 B2
(45) Date of Patent: Nov. 8, 2011

(54) DEVELOPING DEVICE WITH IMAGE SUPPORTING MEMBER AND DEVELOPER SUPPORTING MEMBER DISPOSED IN SPECIFIC ARRANGEMENT, AND IMAGE FORMING APPARATUS

(75) Inventor: Takaaki Ebe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 546 days.

(21) Appl. No.: 12/153,091

(22) Filed: May 14, 2008

(65) Prior Publication Data

US 2008/0298854 A1 Dec. 4, 2008

(30) Foreign Application Priority Data

May 28, 2007 (JP) ..... 2007-140706

(51) Int. Cl.
*G03G 15/08* (2006.01)

(52) U.S. Cl. ..... 399/279; 399/222

(58) Field of Classification Search ..... 399/222, 399/279

See application file for complete search history.

(56) References Cited

U.S. PATENT DOCUMENTS

2006/0002741 A1* 1/2006 Mimura et al. ..... 399/222

FOREIGN PATENT DOCUMENTS

| | | |
|---|---|---|
| JP | 2001-350351 | 12/2001 |
| JP | 2003-316112 | 11/2003 |
| JP | 2006-048018 | 2/2006 |

* cited by examiner

*Primary Examiner* — David Gray
*Assistant Examiner* — G. M. Hyder
(74) *Attorney, Agent, or Firm* — Kubotera & Associates, LLC

(57) ABSTRACT

A developing device includes a developer supporting member abutting against an image supporting member for developing a static latent image on the image supporting member. In a state that a film member is disposed between the image supporting member and the developer supporting member, it is arranged such that the film member is extended with a tensional force N (N) when the image supporting member and the developer supporting member rotate. The tensional force N has a relationship as follows:

$$(A \times B \times \exp(0.32 \times F - 16))/N \leqq 11.6$$

where A (mm) is a difference between an outer diameter of a center portion of the developer supporting member and an outer diameter of an end portion of the developer supporting member; B (mm) is a wobble amount of the end portion of the developer supporting member; and F (degree) is an Asker C hardness of the developer supporting member.

12 Claims, 16 Drawing Sheets

| End portion outer diameter | Center portion outer diameter | Crown amount A | Wobble amount B | Asker C hardness F | Tensional force N | Blank portion |
|---|---|---|---|---|---|---|
| 15.902 | 15.917 | 0.015 | 0.015 | 83 | 1.6 | ○ |
| 15.911 | 15.941 | 0.030 | 0.015 | 83 | 1.6 | ○ |
| 15.906 | 15.966 | 0.060 | 0.015 | 83 | 1.6 | × |
| 15.899 | 15.919 | 0.020 | 0.020 | 81 | 1.6 | ○ |
| 15.910 | 15.956 | 0.046 | 0.020 | 81 | 1.6 | × |
| 15.885 | 15.940 | 0.055 | 0.020 | 81 | 1.6 | × |

FIG. 10

| End portion outer diameter | Center portion outer diameter | Crown amount A | Wobble amount B | Asker C hardness F | Tensional force N | Blank portion |
|---|---|---|---|---|---|---|
| 15.902 | 15.917 | 0.015 | 0.015 | 83 | 1.4 | ○ |
| 15.909 | 15.924 | 0.015 | 0.030 | 83 | 1.4 | × |
| 15.904 | 15.919 | 0.015 | 0.050 | 83 | 1.4 | × |
| 15.896 | 15.946 | 0.050 | 0.015 | 81 | 2.0 | ○ |
| 15.918 | 15.968 | 0.050 | 0.030 | 81 | 2.0 | × |

FIG. 11

| End portion outer diameter | Center portion outer diameter | Crown amount A | Wobble amount B | Asker C hardness F | Tensional force N | Blank portion |
|---|---|---|---|---|---|---|
| 15.913 | 15.988 | 0.075 | 0.020 | 75 | 1.4 | ○ |
| 15.909 | 15.984 | 0.075 | 0.020 | 77 | 1.4 | ○ |
| 15.911 | 15.986 | 0.075 | 0.020 | 79 | 1.4 | ○ |
| 15.901 | 15.976 | 0.075 | 0.020 | 83 | 1.4 | × |

FIG. 12

| End portion outer diameter | Center portion outer diameter | Crown amount A | Wobble amount B | Asker C hardness F | Tensional force N | Blank portion |
|---|---|---|---|---|---|---|
| 15.905 | 15.925 | 0.020 | 0.030 | 83 | 1.4 | × |
| 15.905 | 15.925 | 0.020 | 0.030 | 83 | 1.6 | × |
| 15.905 | 15.925 | 0.020 | 0.030 | 83 | 2.0 | ○ |

FIG. 13

| End portion outer diameter | Center portion outer diameter | Crown amount A | Wobble amount B | Asker C hardness F | Tensional force N | Blank portion | A × B × exp (0.32 × F-16)/N |
|---|---|---|---|---|---|---|---|
| 15.913 | 15.933 | 0.020 | 0.030 | 55 | 1.2 | ○ | 0.0025 |
| 15.899 | 15.909 | 0.010 | 0.005 | 65 | 2.0 | ○ | 0.0030 |
| 15.899 | 15.909 | 0.010 | 0.005 | 65 | 1.2 | ○ | 0.0051 |
| 15.910 | 15.930 | 0.020 | 0.030 | 65 | 1.2 | ○ | 0.0608 |
| 15.895 | 15.905 | 0.010 | 0.020 | 77 | 1.4 | ○ | 0.8076 |
| 15.904 | 15.914 | 0.010 | 0.030 | 79 | 1.4 | ○ | 2.3 |
| 15.913 | 15.988 | 0.075 | 0.020 | 75 | 1.4 | ○ | 3.2 |
| 15.899 | 15.919 | 0.020 | 0.020 | 81 | 1.6 | ○ | 5.1 |
| 15.902 | 15.917 | 0.015 | 0.015 | 83 | 1.6 | ○ | 5.4 |
| 15.909 | 15.984 | 0.075 | 0.020 | 77 | 1.4 | ○ | 6.1 |
| 15.902 | 15.917 | 0.015 | 0.015 | 83 | 1.4 | ○ | 6.2 |
| 15.896 | 15.946 | 0.050 | 0.015 | 81 | 2.0 | ○ | 7.6 |
| 15.896 | 15.996 | 0.100 | 0.015 | 78 | 1.4 | ○ | 8.3 |
| 15.911 | 15.941 | 0.030 | 0.015 | 83 | 1.6 | ○ | 10.8 |
| 15.911 | 15.986 | 0.075 | 0.020 | 79 | 1.4 | ○ | 11.5 |
| 15.905 | 15.925 | 0.020 | 0.030 | 83 | 2.0 | ○ | 11.6 |
| 15.909 | 15.955 | 0.046 | 0.020 | 81 | 1.6 | × | 11.7 |
| 15.909 | 15.924 | 0.015 | 0.030 | 83 | 1.4 | × | 12.4 |
| 15.885 | 15.940 | 0.055 | 0.020 | 81 | 1.6 | × | 14.0 |
| 15.905 | 15.925 | 0.020 | 0.030 | 83 | 1.6 | × | 14.5 |
| 15.918 | 15.968 | 0.050 | 0.030 | 81 | 2.0 | × | 15.2 |
| 15.905 | 15.925 | 0.020 | 0.030 | 83 | 1.4 | × | 16.5 |
| 15.913 | 15.963 | 0.050 | 0.020 | 83 | 2.0 | × | 19.3 |
| 15.904 | 15.919 | 0.015 | 0.050 | 83 | 1.4 | × | 20.7 |
| 15.906 | 15.966 | 0.060 | 0.015 | 83 | 1.6 | × | 21.7 |
| 15.901 | 15.976 | 0.075 | 0.020 | 83 | 1.4 | × | 41.3 |
| 15.905 | 15.942 | 0.037 | 0.045 | 83 | 1.4 | × | 45.9 |

FIG. 14

| End portion outer diameter | Center portion outer diameter | Crown amount A | Wobble amount B | Asker C hardness F | Tensional force N | Blank portion | $A \times B \times \exp(0.32 \times F-16)/N$ |
|---|---|---|---|---|---|---|---|
| 15.913 | 15.933 | 0.020 | 0.030 | 55 | 1.2 | ○ | 0.0025 |
| 15.899 | 15.909 | 0.010 | 0.005 | 65 | 2.0 | ○ | 0.0030 |
| 15.899 | 15.909 | 0.010 | 0.005 | 65 | 1.2 | ○ | 0.0051 |
| 15.910 | 15.930 | 0.020 | 0.030 | 65 | 1.2 | ○ | 0.06 |
| 15.895 | 15.905 | 0.010 | 0.020 | 77 | 1.3 | ○ | 0.87 |
| 15.904 | 15.914 | 0.010 | 0.030 | 79 | 1.4 | ○ | 2.3 |
| 15.913 | 15.988 | 0.075 | 0.020 | 75 | 1.5 | ○ | 3.0 |
| 15.899 | 15.919 | 0.020 | 0.020 | 81 | 1.6 | ○ | 5.1 |
| 15.902 | 15.917 | 0.015 | 0.015 | 83 | 1.4 | ○ | 6.2 |
| 15.909 | 15.984 | 0.075 | 0.020 | 77 | 1.3 | ○ | 6.5 |
| 15.902 | 15.917 | 0.015 | 0.015 | 83 | 1.2 | ○ | 7.2 |
| 15.896 | 15.946 | 0.050 | 0.015 | 81 | 2.0 | ○ | 7.6 |
| 15.896 | 15.996 | 0.100 | 0.015 | 78 | 1.4 | ○ | 8.3 |
| 15.911 | 15.941 | 0.030 | 0.015 | 83 | 1.6 | ○ | 10.8 |
| 15.911 | 15.986 | 0.075 | 0.020 | 79 | 1.4 | ○ | 11.5 |
| 15.905 | 15.925 | 0.020 | 0.030 | 83 | 2.0 | ○ | 11.6 |
| 15.909 | 15.955 | 0.046 | 0.020 | 81 | 1.5 | × | 12.5 |
| 15.909 | 15.924 | 0.015 | 0.030 | 83 | 1.3 | × | 13.3 |
| 15.885 | 15.940 | 0.055 | 0.020 | 81 | 1.6 | × | 14.0 |
| 15.905 | 15.925 | 0.020 | 0.030 | 83 | 1.6 | × | 14.5 |
| 15.918 | 15.968 | 0.050 | 0.030 | 81 | 2.0 | × | 15.2 |
| 15.905 | 15.925 | 0.020 | 0.030 | 83 | 1.4 | × | 16.5 |
| 15.913 | 15.963 | 0.050 | 0.020 | 83 | 1.9 | × | 20.3 |
| 15.904 | 15.919 | 0.015 | 0.050 | 83 | 1.4 | × | 20.7 |
| 15.906 | 15.966 | 0.060 | 0.015 | 83 | 1.6 | × | 21.7 |
| 15.901 | 15.976 | 0.075 | 0.020 | 83 | 1.3 | × | 44.5 |
| 15.905 | 15.942 | 0.037 | 0.045 | 83 | 1.4 | × | 45.9 |

FIG. 16

DEVELOPING DEVICE WITH IMAGE SUPPORTING MEMBER AND DEVELOPER SUPPORTING MEMBER DISPOSED IN SPECIFIC ARRANGEMENT, AND IMAGE FORMING APPARATUS

BACKGROUND OF THE INVENTION

The present invention relates to a developing device and an image forming apparatus.

In a conventional image forming apparatus, a developing device is provided with a developer supporting member. The developer supporting member may have a crown shape having a difference in outer diameters between a center portion thereof and a end portion thereof in an axial direction thereof. Accordingly, it is possible to maintain a constant nip amount with respect to an image supporting member (refer to Patent Reference).

Patent Reference: Japan Patent Publication No. 2001-350351

In the conventional developing device described above, even though the developer supporting member has a crown shape, when the developer supporting member has an elastic layer having a high hardness, and an end portion thereof tends to wobble to a large extent, the nip amount tends to decrease at the end portion. Accordingly, it is difficult to develop a static latent image on the image supporting member, thereby causing a blank portion in an image.

In view of the problem described above, an object of the invention is to provide a developing device and an image forming device, in which it is possible to solve the problems of the conventional developing device. In the developing device, in a state that a film member is disposed between an image supporting member and a developer supporting member, it is arranged such that the film member is extended with a force within a specific range when the image supporting member and the developer supporting member rotate. Accordingly, it is possible to obtain a sufficient nip amount between the image supporting member and the developer supporting member, thereby preventing a blank portion in an image due to an insufficient nip amount.

Further objects of the invention will be apparent from the following description of the invention.

SUMMARY OF THE INVENTION

In order to attain the objects described above, according to the present invention, a developing device includes a developer supporting member abutting against an image supporting member for developing a static latent image on the image supporting member. In a state that a film member is disposed between the image supporting member and the developer supporting member, it is arranged such that the film member is extended with a tensional force N (N) when the image supporting member and the developer supporting member rotate. The tensional force N has a relationship as follows:

$$(A \times B \times exp(0.32 \times F - 16))/N \leqq 11.6$$

where A (mm) is a difference between an outer diameter of a center portion of the developer supporting member and an outer diameter of an end portion of the developer supporting member; B (mm) is a wobble amount of the end portion of the developer supporting member; and F (degree) is an Asker C hardness of the developer supporting member.

In the developing device of the present invention, the film member is disposed between the image supporting member and the developer supporting member. Further, it is arranged such that the film member is extended with the tensional force N within the specific range when the image supporting member and the developer supporting member rotate. Accordingly, it is possible to obtain a sufficient nip amount between the image supporting member and the developer supporting member, thereby preventing a blank portion in an image due to an insufficient nip amount.

BRIEF DESCRIPTION OF THE DRAWINGS

FIG. 10 is a table showing an evaluation result No. 1 according to the first embodiment of the present invention;

FIG. 11 is a table showing an evaluation result No. 2 according to the first embodiment of the present invention;

FIG. 12 is a table showing an evaluation result No. 3 according to the first embodiment of the present invention;

FIG. 13 is a table showing an evaluation result No. 4 according to the first embodiment of the present invention;

FIG. 14 is a table showing an evaluation result No. 5 according to the first embodiment of the present invention;

FIG. 16 is a table showing an evaluation result according to the second embodiment of the present invention;

DETAILED DESCRIPTION OF THE PREFERRED EMBODIMENTS

Hereunder, embodiments of the present invention will be described in detail with reference to the accompanying drawings.

First Embodiment

Figure 1:
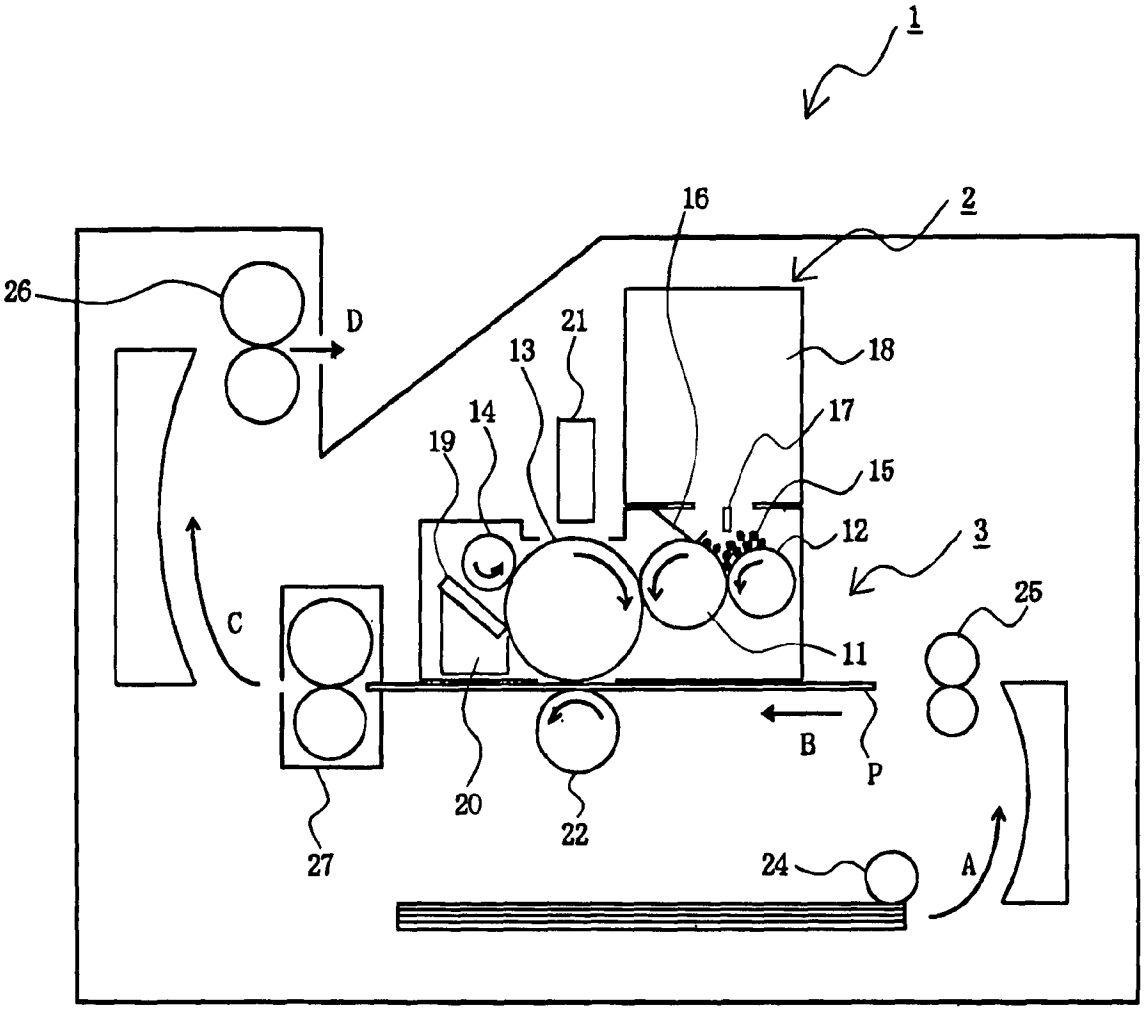
FIG. 1 is a schematic view showing an image forming apparatus according to a first embodiment of the present invention.

A first embodiment of the present invention will be explained. FIG. 1 is a schematic view showing an image forming apparatus 1 according to the first embodiment of the present invention.

In the embodiment, the image forming apparatus 1 may be any type of image forming apparatus such as a printer of an electro-photography type, a facsimile, a copier, a multi-function printer having functions of a printer, a facsimile, and a copier. In the following description, the image forming apparatus 1 is an electro-photography type printer for forming an image through electro-photography. Further, the image forming apparatus 1 is an apparatus for forming a monochrome image, and may be an apparatus for forming a color image.

As shown in FIG. 1, in the image forming apparatus 1, an image forming unit 2 and a fixing device 27 are disposed along a transportation path of a recording medium P. A sheet supply roller 24 supplies the recording medium P placed in a sheet cassette and the likes one by one in a separated state, so that the recording medium P is transported to a register roller 25 in an arrow direction A.

Afterward, the recording medium P is transported with the register roller 25 in an arrow direction B at a specific timing. While the recording medium P is being transported along the transportation path, the image forming unit 2 forms a toner image, and a transfer roller 22 transfers the toner image to the recording medium P.

When the recording medium P is transported to the fixing device 27, the fixing device 27 performs a fixing process, so that the toner image is fixed to the recording medium P. After the toner image is fixed to the recording medium P, the recording medium P is transported in an arrow direction C. Then, a discharge roller 26 discharges the recording medium P in an arrow direction D, thereby storing the recording medium P in a stacker disposed outside the image forming apparatus 1.

As shown in FIG. 1, the image forming apparatus 1 further includes a developing device 3. The developing device 3 retains toner 15 as developer supplied from a toner cartridge 18 as a developer container.

In the embodiment, the developing device 3 includes a photosensitive drum 13 as an image supporting member; a developing roller 11 as a developer supporting member disposed to face the photosensitive drum 13 and to be rotatable; a toner supply roller 12 as a supply member for supplying the toner 15 to the developing roller 11; a charging roller 14 as a charging member for charging the photosensitive drum 13; a developer blade 16 as a toner layer thickness regulation blade for forming a thin layer of the toner 15 supplied on the developing roller 11; a stirring member 17 for maintaining flowability of the toner 15 in the developing device 3; and a cleaning blade 19 for collecting fog toner or transfer remaining toner on the photosensitive drum 13.

In the embodiment, the developing device 3 further includes a space 20 for retaining waste toner scraped off with the cleaning blade 19. A spiral and the like discharges waste toner from the developing device 3 into a waste toner container (not shown). Note that the developing roller 11, the toner supply roller 12, the photosensitive drum 13, and the charging roller 14 rotate in arrow directions, respectively.

In the embodiment, a print head 21 as an LED (Light Emitting Diode) head having an LED as a light emitting element is provided for exposing a surface of the photosensitive drum 13 to form a static latent image thereon according to image data.

In the embodiment, the photosensitive drum 13 includes an aluminum pipe having an outer diameter of 30 mm and a thickness of 0.75 mm. A charge generation layer and a charge transportation layer are formed on the aluminum pipe.

The charge generation layer contains a charge generation material such as an inorganic photoconductive material like selenium and an alloy thereof, selenium arsenic compound, cadmium sulfide, zinc oxide, and the likes; and an organic dye or pigment such as phthalocyanine, azo-dye, quinacridone; polycyclic quinone, pyrylium salt, thia-pyrylium salt, indigo, thio-indigo, anthoanthron, pyranethron, cyanine, and the likes. In particular, it is preferred to use a metal and an oxide thereof such as metal-free phthalocyanine, capper indium chloride, gallium chloride, tin, oxy-titanium, zinc, vanadium; phthalocyanine compound having a chloride complex; and an azo dye such as mono-azo, bis-azo, thris-azo, poly-azo, and the likes.

In the embodiment, the charge generation layer may be formed of a dispersion layer. In the dispersion layer, the charge generation material may be bound with a binder resin such as a polyester resin, polyvinyl acetate, polyacrylic acid ester, polymethacrylic acid ester, polycarbonate, polyvinyl acetoacetal, polyvinyl propional, polyvinyl butyral, a phenoxy resin, a cellulose ester, a cellulose ether, and the likes. In the dispersion layer, the charge generation material may be contained in a range of 30 to 500 weight parts relative to the binder resin of 100 weight parts. The charge generation layer may have a thickness of 0.1 to 2 μm.

In the embodiment, the charge transportation layer is formed of polycarbonate as a binder resin, and has a thickness of 5 to 30 μm. The toner 15 is crashed toner having an average particle diameter of 5.7 μm and a degree of circularity of 0.950. The degree of circularity is measured with a flow-type particle image analyzer EPIA-300 (a product of Sysmex Corporation).

Figure 2:
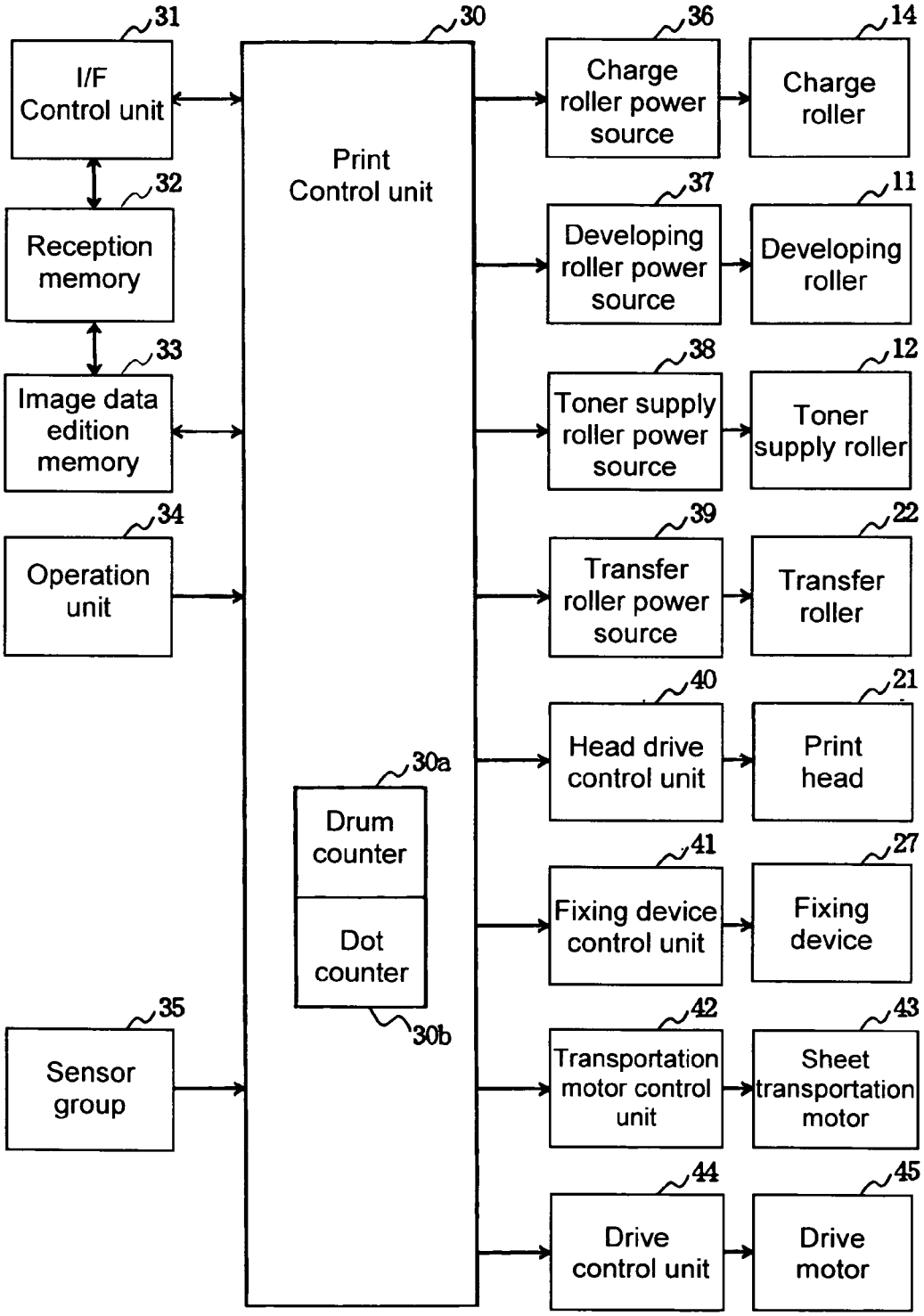
FIG. 2 is a block diagram showing a control system of the image forming apparatus according to the first embodiment of the present invention.

A control system of the image forming apparatus 1 will be explained next. FIG. 2 is a block diagram showing the control system of the image forming apparatus 1 according to the first embodiment of the present invention.

As shown in FIG. 2, the control system includes a print control unit 30 having a microprocessor, an ROM, an RAM, an input/output port, a timer, and the likes. The print control unit 30 receives print data and a control command from a host device (not shown) through an interface (I/F) control unit 31, so that the print control unit 30 controls a whole sequence of the image forming apparatus 1, thereby performing a printing operation.

In the embodiment, the control system includes a reception memory 32 for temporarily storing the print data input from the host device through the interface (I/F) control unit 31. The control system further includes an image data edition memory 33 for receiving the print data stored in the reception memory 32, and for storing image data created through image editing of the print data.

In the embodiment, the control system includes an operation unit 34 having a display unit such as an LED for displaying a status of the image forming apparatus 1; and an input unit such as a switch for sending a direction of an operator to the image forming apparatus 1. The control system further includes a sensor group 35 formed of various sensors such as a sheet position detection sensor, a temperature/humidity sensor, a density sensor, and the likes for monitoring an operational state of the image forming apparatus 1.

In the embodiment, the control system includes a charge roller power source 36 for applying a specific voltage to the charging roller 14 according a direction of the print control unit 30, so that the surface of the photosensitive drum 13 is charged. The control system further includes a developing roller power source 37 for applying a specific voltage to the developing roller 11, so that the toner 15 is adhered to the static latent image.

In the embodiment, the control system includes a toner supply roller power source 38 for applying a specific voltage to the toner supply roller 12, so that the toner 15 is supplied to the developing roller 11. The control system further includes a transfer roller power source 39 for applying a specific voltage to the transfer roller 22, so that the toner image formed on the photosensitive drum 13 as the developer image is transferred to the recording medium P. Note that the print control unit 30 controls the charge roller power source 36, the developing roller power source 37, and the toner supply roller power source 38 to change the voltages thereof.

In the embodiment, the control system includes a head drive control unit 40 for sending the image data stored in the image data edition memory 33 to the print head 21, and for driving the print head 21. The control system further includes a fixing device control unit 41 for applying a voltage to the fixing device 27 as the diving unit, so that the toner image thus transferred is fixed to the recording medium P.

In the embodiment, the fixing device 27 includes a heater (not shown) for melting the toner 15 of the toner image on the recording medium P, and a temperature sensor (not shown) for detecting a temperature. The fixing device control unit 41 reads a sensor output of the temperature sensor, and turns on the heater according to the sensor output, so that the fixing device 27 maintains a constant temperature.

In the embodiment, the control system includes a transportation motor control unit 42 for controlling a sheet transportation motor 43 to transport the recording medium P. The transportation motor control unit 42 transports and stops the recording medium P at a specific timing according to a direction of the print control unit 30. The sheet transportation motor 43 rotates the sheet supply roller 24, the register roller 25, and the discharge roller 26. The recording medium P is transported in the arrow directions A to D.

In the embodiment, the control system includes a drive control unit 44 for driving a drive motor 45 to operate the toner supply roller 12. When the drive control unit 44 drives the drive motor 45, the photosensitive drum 13 rotates in the arrow direction as shown in FIG. 1. At the same time, the charging roller 14, the developing roller 11, and the toner supply roller 12 rotate in the arrow directions, respectively.

In the embodiment, the control system includes a drum counter 30*a* for counting a rotational number of the photosensitive drum 13, and a dot counter 30*b* for counting print dots.

Figure 3:
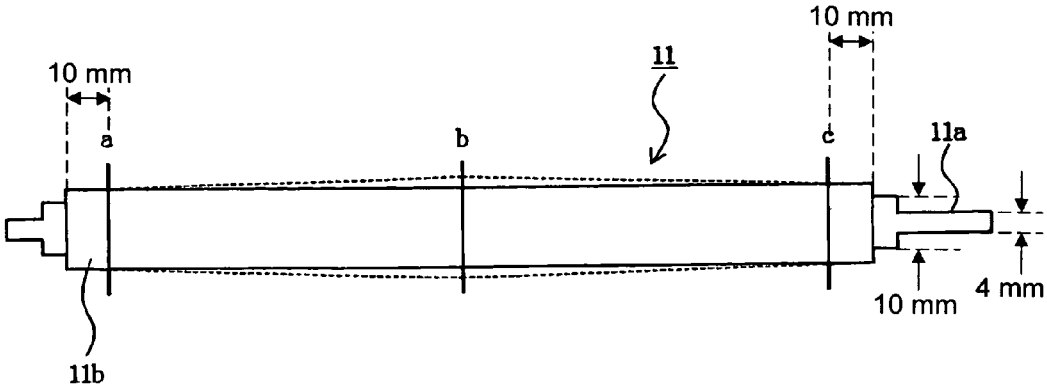
FIG. 3 is a schematic view showing a developing roller according to the first embodiment of the present invention.
Figure 4:
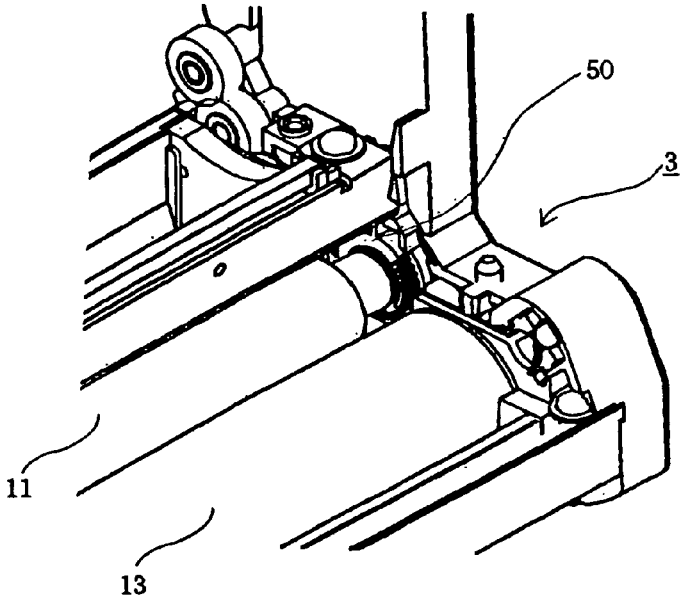
FIG. 4 is a perspective view showing a bearing portion of the developing roller according to the first embodiment of the present invention.

The developing roller 11 will be explained in more detail next. FIG. 3 is a schematic view showing the developing roller 11 according to the first embodiment of the present invention. FIG. 4 is a perspective view showing a bearing portion 51 of the developing roller 11 according to the first embodiment of the present invention.

Figure 5:
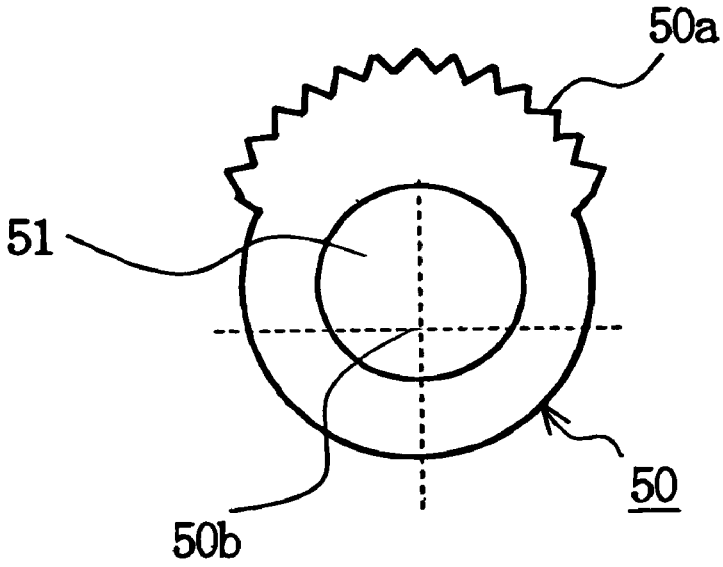
FIG. 5 is a schematic sectional view showing the bearing portion of the developing roller according to the first embodiment of the present invention.
Figure 6:
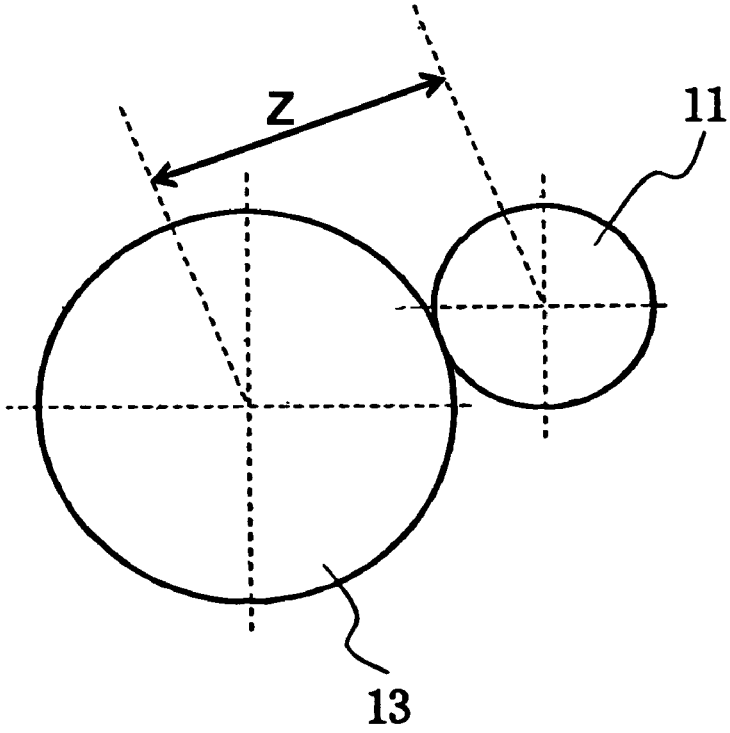
FIG. 6 is a schematic view showing a distance between rotational shafts of the developing roller and a photosensitive drum according to the first embodiment of the present invention.
Figure 7:
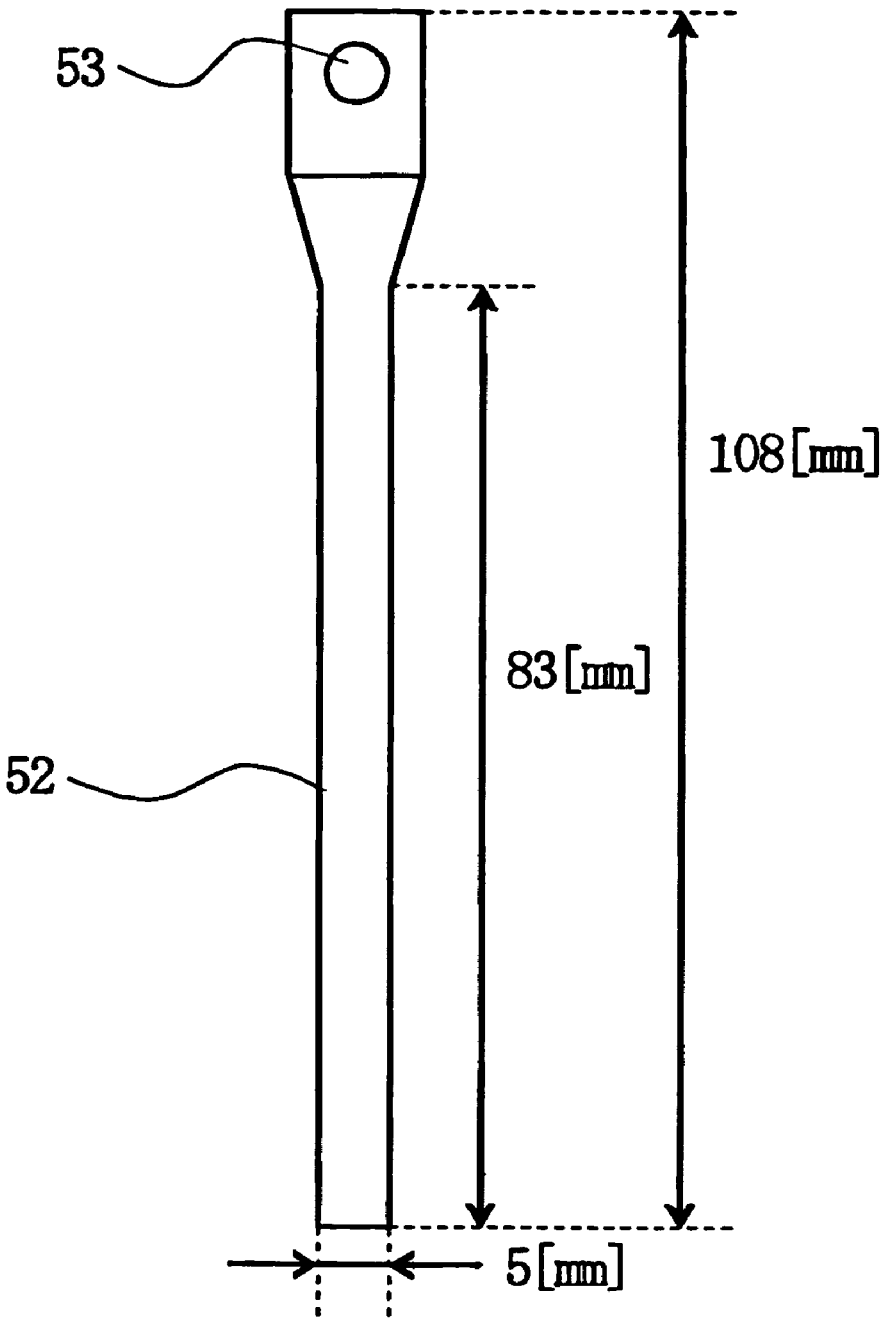
FIG. 7 is a schematic view showing a film for measuring a tensional force according to the first embodiment of the present invention.

FIG. 5 is a schematic sectional view showing the bearing portion 51 of the developing roller 11 according to the first embodiment of the present invention. FIG. 6 is a schematic view showing a distance between rotational shafts of the developing roller 11 and the photosensitive drum 13 according to the first embodiment of the present invention. FIG. 7 is a schematic view showing a film 52 for measuring a tensional force according to the first embodiment of the present invention.

As shown in FIG. 3, the developing roller 11 includes a shaft metal 11*a* formed of an SUS (stainless steel), and an elastic layer (rubber portion) 11*b* formed of a polyether type urethane on the shaft metal 11*a*. The elastic layer 11*b* on the shaft metal 11*a* has an outer diameter of 10 mm, and the shaft metal 11*a* has an end portion having an outer diameter of 4 mm. The elastic layer 11*b* has a length of 230 mm.

In the embodiment, the developing roller 11 has an outer diameter of 15.90 mm at positions a and c 10 mm away from both end portions of the elastic layer 11*b*. Further, the developing roller 11 has a crown shape, in which an outer diameter at a center position b of the elastic layer 11*b* is varied with respect to the outer diameter of the end portion.

In the embodiment, as shown in FIG. 4, the developing roller 11 abuts against the photosensitive drum 13 with a distance between rotational axes thereof constant. As shown in FIG. 5, a bearing 50 is provided with a gear 50*a* on a part of an outer circumference thereof. Accordingly, it is possible to rotate the bearing 50 through the gear 50*a* from outside the image forming apparatus 1.

In the embodiment, a rotational shaft 50*b* of the bearing 50 has a center position shifted from that of the bearing portion 51. Accordingly, when the bearing 50 rotates, it is possible to adjust a distance Z between the rotational shafts of the developing roller 11 and the photosensitive drum 13 in a range of 22.785 and 22.986 mm. Note that the developing roller 11 is pressed against the photosensitive drum 13 with a force of 14 g/mm.

With the bearing 50 described above, it is possible to adjust a nip amount between the developing roller 11 and the photosensitive drum 13. As an indicator upon adjusting the nip amount, a tensional force is adopted. As shown in FIG. 7, the film 52 as a film member is inserted between the developing roller 11 and the photosensitive drum 13, and the tensional force is measured as a force pulling the film 52 when the developing roller 11 and the photosensitive drum 13 rotate.

In the embodiment, the film 52 is formed of polypropylene, and has a width of 5 mm and a thickness of 0.04 mm. Further, the film 52 has a ten-point average surface roughness Rz of equal to or less than 0.5 μm. The film 52 has a hole 53 for hooking a tension gauge. The ten-point average surface roughness Rz is measured according to JIS B0601-1994.

Figure 8:
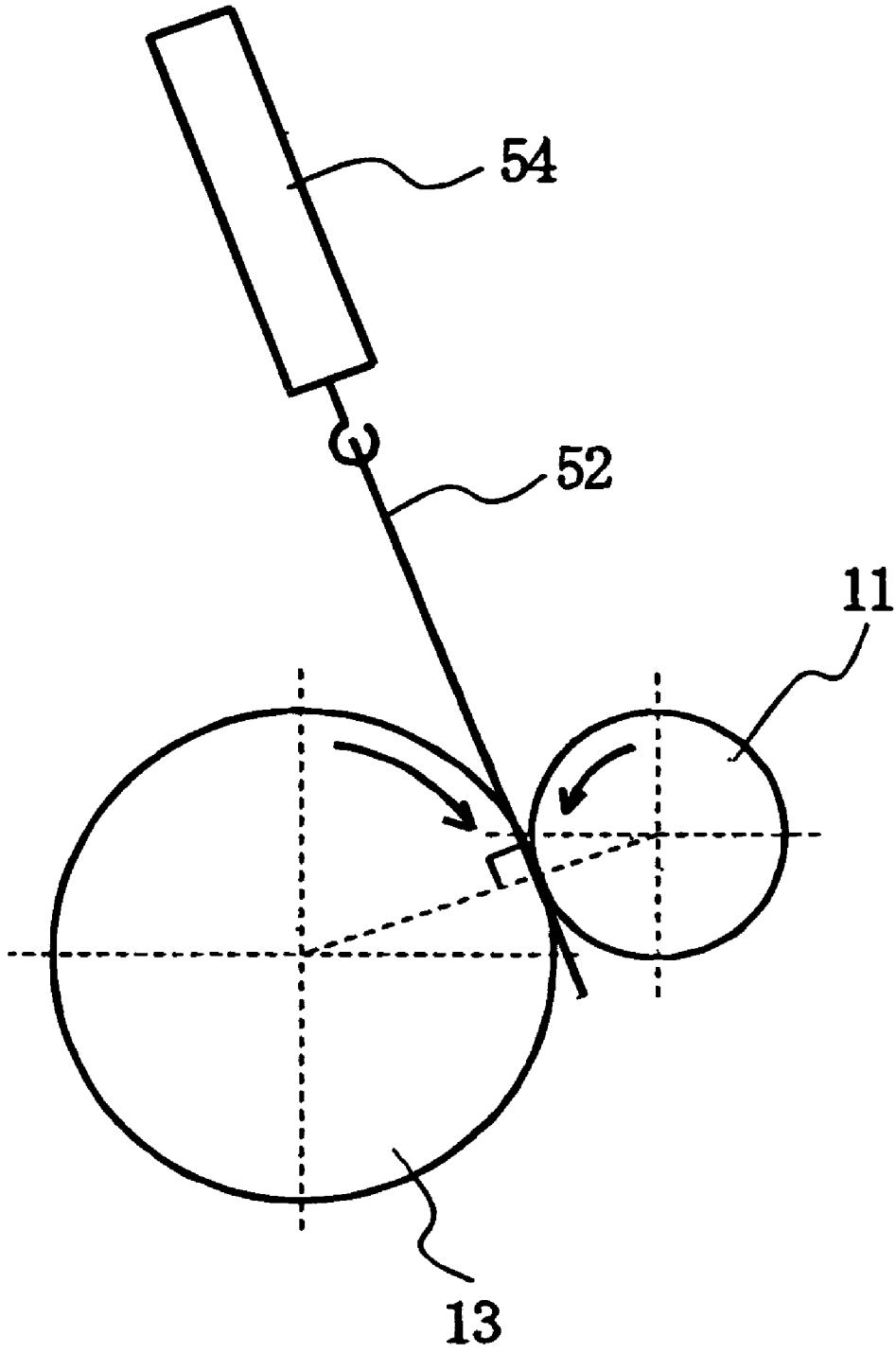
FIG. 8 is a schematic view showing a method of measuring the tensional force according to the first embodiment of the present invention.

A method of measuring the tensional force will be explained next. FIG. 8 is a schematic view showing the method of measuring the tensional force according to the first embodiment of the present invention.

In the embodiment, the tensional force is measured in a state that the developing device 3 is assembled as shown in FIG. 4. In this state, the toner 15 is adhered to the surface of the developing roller 11, and the film 52 is inserted at the positions a and c shown in FIG. 3, away from the end portions of the developing roller 11 by 10 mm.

As shown in FIG. 8, the film 52 is arranged to extend perpendicular to a line between the rotational shafts of the developing roller 11 and the photosensitive drum 13. A tension gauge 54 for measuring the tensional force is arranged in the same angle on an extension line of the film 52. A digital gauge model RX (a product of Aikoh Engineering Co., Ltd.) is used as the tension gauge 54.

In the measurement, the photosensitive drum 13 and the developing roller 11 rotate in arrow directions as shown in FIG. 8. More specifically, the photosensitive drum 13 rotates at a circumferential speed of 143 mm/sec., and the developing roller 11 rotates at a circumferential speed of 178 mm/sec. The tensional force applied to the film 52 is measured with the tension gauge 54 for ten seconds, and a personal computer retrieves a measurement value of the tensional force every 0.01 second.

Figure 9:
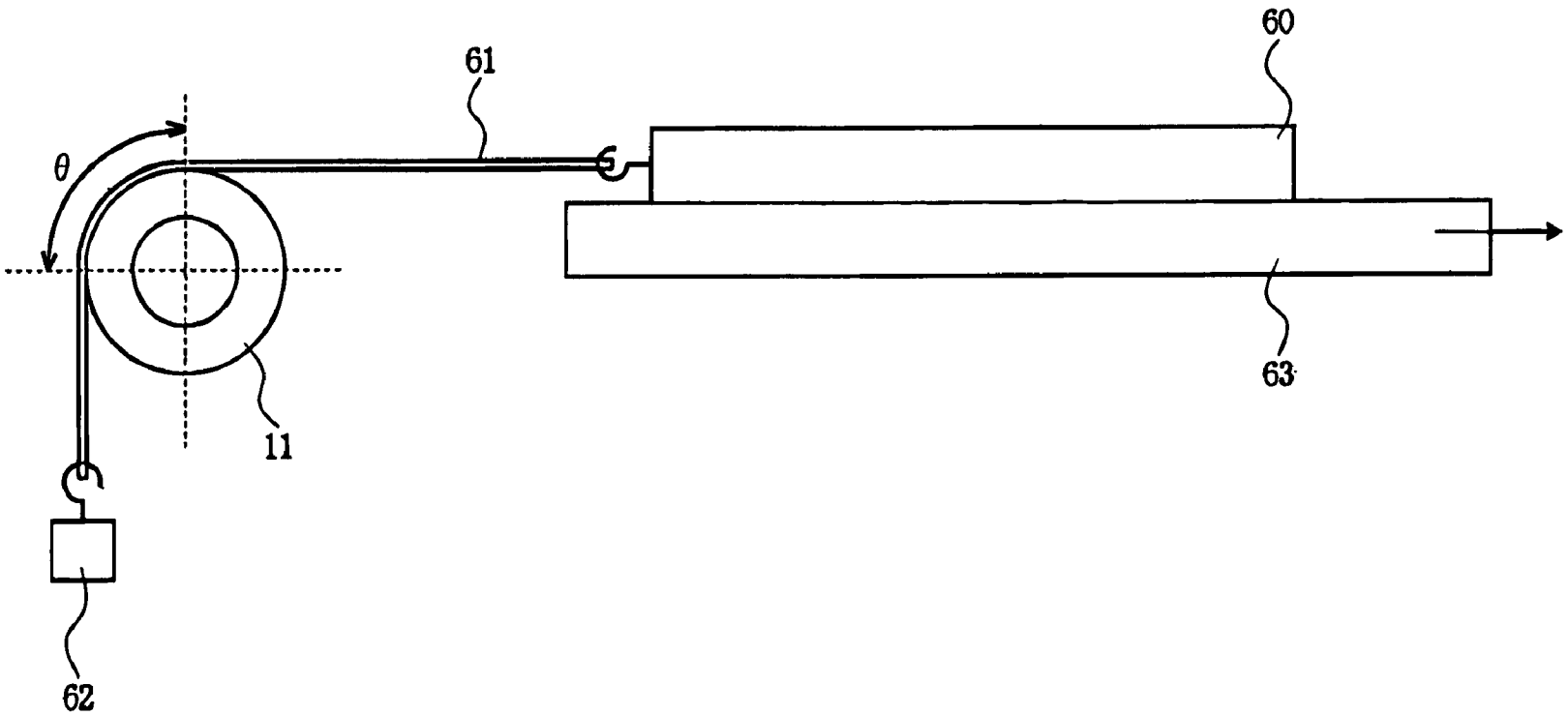
FIG. 9 is a schematic view showing a method of measuring a dynamic friction coefficient of a surface of the developing roller according to the first embodiment of the present invention.

An experiment was conducted to obtain a condition for preventing a blank portion on a printed sheet in the developing device 3 as follows. FIG. 9 is a schematic view showing a method of measuring a dynamic friction coefficient of a surface of the developing roller 11 according to the first embodiment of the present invention.

FIG. 10 is a table showing an evaluation result No. 1 when a crown amount A was changed according to the first embodiment of the present invention; FIG. 11 is a table showing an evaluation result No. 2 when a wobble amount B was changed according to the first embodiment of the present invention; FIG. 12 is a table showing an evaluation result No. 3 when a Asker C hardness F was changed according to the first embodiment of the present invention; FIG. 13 is a table showing an evaluation result No. 4 when a tensional force N was changed according to the first embodiment of the present invention; and FIG. 14 is a table showing an evaluation result No. 5 according to the first embodiment of the present invention.

In the experiment for determining whether the blank portion was formed at end portions of an image, the developing device 3 was used for performing solid printing under a condition of a low temperature and a low humidity, i.e., a temperature of 10° C. and a humidity of 20%, while the hardness F, the crown amount A, and the wobble amount B of the developing roller 11 were changed. The wobble amount B represents deflection of the developing roller 11.

When the nip amount between the developing roller 11 and the photosensitive drum 13 is not sufficient, the toner 15 on the developing roller 11 is not developed to the photosensitive drum 13, thereby forming the blank portion. When the printing operation is performed under a condition of a low temperature and a low humidity, an outer diameter of the developing roller 11 tends to shrink, thereby lowering a nip pressure thereof.

In the experiment, the elastic layer 11*b* of the developing roller 11 was formed of polyether type urethane, and a coating (for example, isocyanate processing, polyether type urethane coating, and the likes) was applied to a surface of the elastic layer 11*b* for providing the toner 15 with an electrical charging property. The Asker C hardness F of the elastic layer 11*b* was changed through changing a mixing ratio of cross-linking agent. The crown amount A and the wobble amount B were changed through changing a polishing condition.

In the experiment, the elastic layer 11*b* had the Asker C hardness of 55 to 83 degrees. The crown amount A was between 0.01 and 0.1 mm. The surface of the developing roller 11 had the ten-point average roughness Rz of 3 to 5 μm and a roughness density Sm of 50 to 120 μm along a circumferential direction thereof. The roughness density Sm was measured according to JIS B0601-1994.

In the experiment, the crown amount A was between 0.01 and 0.1 mm, so that a contact pressure between the developing roller 11 and the photosensitive drum 13 became uniform along an axial direction thereof upon rotating. When the crown amount A is less than 0.01 mm, the contact pressure does not become uniform. Accordingly, the contact pressure at the end portion in the axial direction becomes too high, thereby causing excessive damage on the toner 15. As a result, reproducibility of a fine dot such as 2 by 2 tends to deteriorate (upon forming dots for four sections of two dots in a lateral direction and two dots in a vertical direction among sixteen sections of four dots in the lateral direction and four dots in the vertical direction). When the crown amount A is greater than 0.1 mm, the contact pressure does not become uniform. Accordingly, the contact pressure at the end portion in the axial direction becomes too low, thereby causing the blank portion.

A dynamic friction coefficient μ was measured from Euler's belt equation, and was found to be 1.3 to 1.8. The dynamic friction coefficient μ was measured with the method shown in FIG. 9.

As shown in FIG. 9, a tension gauge 60 was a DIGITAL FORCE GAUGE ZP-501N (a product of IMADA). A stage 63 was arranged to move in an arrow direction, and was a small direct drive series SPL4.2 (a product of Oriental Motor Co., Ltd.). The tension gauge 60 was fixed to the stage 63. A belt 61 (width; 50 mm, length; 200 mm) contacted with the developing roller 11 supported at a specific angle θ, and had one end portion connected to the tension gauge 60 and the other end portion connected to a weight 62.

In this state, the stage 63 moved at a speed of 1.2 mm/sec. for five seconds in an arrow direction. A load applied to the tension gauge 60 upon moving the stage 63 was measured, thereby obtaining the dynamic friction coefficient μ. The belt 61 was formed of an excellent white paper with a small variance in a surface state per piece (product name; PPR-CA4NA, 80 g/m$^2$, a product of Oki Data Corporation). A weight of the weight 62 was 10 g. The dynamic friction coefficient μ was obtained from Euler's belt equation (1) as follows:

$$\mu=1/\theta\times 1n(K/W) \quad (1)$$

In the experiment, the developing roller 11 was pushed into the photosensitive drum 13 by about 0.1 mm. Further, the developing roller 11 rotated at a speed faster than that of the photosensitive drum 13, thereby creating a circumferential speed difference. Accordingly, the dynamic friction coefficient μ of the surface of the developing roller 11 had a relatively small influence on the tensional force, and the nip amount of the developing roller 11 and the hardness thereof had a dominant influence on the tensional force. For this reason, in the experiment, it was possible to ignore a variance in the dynamic friction coefficient μ of the surface of the developing roller 11, i.e., 1.3 to 1.8.

FIGS. 10 to 12 are the tables showing the results of the experiment. In the table, the Asker C hardness F of the developing roller 11 was measured with an Asker C hardness meter. More specifically, a probe of the Asker C hardness meter contacted with the elastic layer 11*b* of the developing roller 11, so that the Asker C hardness F of the developing roller 11 was measured.

The crown amount A was defined as a difference in outer diameters at the position b and the position c in FIG. 3. The wobble amount B was measured at the position a and the position c. The tensional force N was measured at the position a and the position c. When the solid printing was conducted, no blank portion represents '○' and the blank portion represents '×'.

In the experiment, the crown amount A and the wobble amount B were measured with a roll shape measurement system RM-202 (a product of Apollo Seiko Ltd.) at a temperature of 25° C. and a relative humidity of 50%. FIGS. 17(*a*) and 17(B) are schematic views showing an arrangement of the measurement of the wobble amount B according to the first embodiment of the present invention.

Figure 17A:
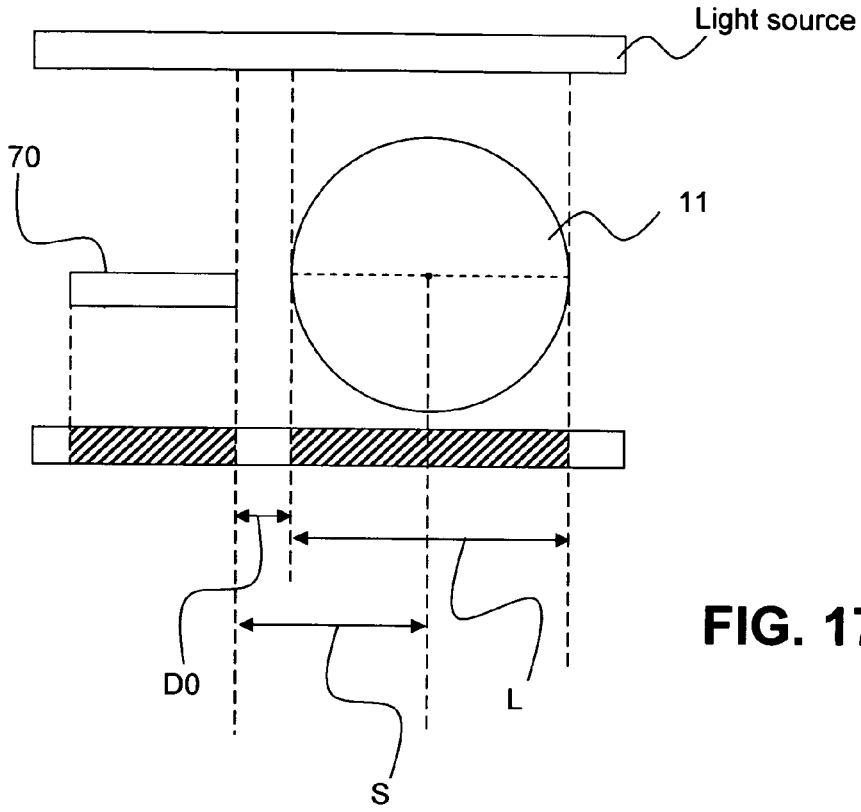
FIGS. 17(*a*) and 17(B) are schematic views showing an arrangement of a measurement of a wobble amount according to the first embodiment of the present invention.
Figure 17B:
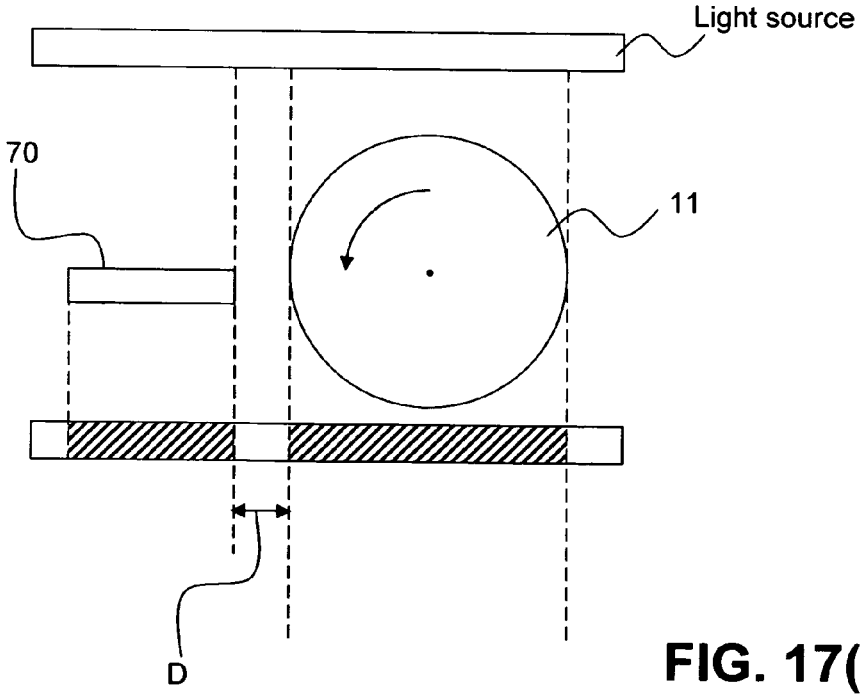

As shown in FIGS. 17(A) and 17(B), a standard member 70 is arranged with respect to the developing roller 11, so that the standard member 70 is away from the rotational center of the developing roller 11 by a distance S. When the developing roller 11 has an average outer diameter L, an actual standard distance D0 between the standard member 70 and the developing roller 11 is given by:

$$D0=S-L/2$$

In the measurement, an actual distance D between the standard member 70 and the developing roller 11 is measured, and an actual outer diameter Ln of the developing roller 11 is given by:

$$D0+(L/2)=D+(Ln/2)$$

$$2\times(D0-D)=Ln-L$$

After the actual outer diameter Ln is measured at a specific number n of measurement positions on the developing roller 11, the wobble amount B is obtained as an average difference between the actual outer diameter Ln and the average outer diameter L (described later).

In the experiment, the measurement was conducted for three seconds at one position with an interval of 0.02 second, while the developing roller 11 was rotating at 35 rpm. The measurement was conducted at the position a and the position c.

In the experiment, the tensional force N was measured at a temperature of 25° C. and a relative humidity of 50%. Further, in FIGS. 10 to 14, the tensional force N was obtained with the tension gauge 60 as an average value of 1000 measurements measured for 10 seconds with an interval of 0.01 second.

FIG. 10 is the table showing the results of the experiment to determine whether the blank portion was formed while the crown amount A was changed. FIG. 11 is the table showing the results of the experiment to determine whether the blank portion was formed while the wobble amount B was changed. FIG. 12 is the table showing the results of the experiment to determine whether the blank portion was formed while the Asker C hardness F was changed. FIG. 13 is the table showing the results of the experiment to determine whether the blank portion was formed while the tensional force N was changed.

As shown in FIGS. 10 to 13, when the crown amount A becomes larger, the blank portion tends to occur. When the wobble amount B becomes larger, the blank portion tends to occur. When the Asker C hardness F becomes larger, the blank portion tends to occur. When the tensional force N becomes smaller, the blank portion tends to occur.

Figure 18:
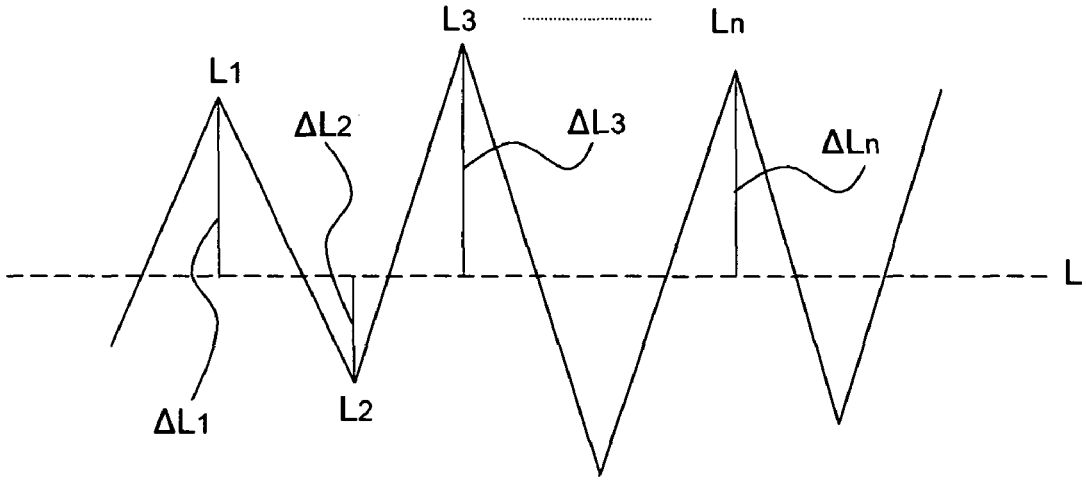
FIG. 18 is a schematic view showing a model of the wobble amount according to the first embodiment of the present invention.

The wobble amount B corresponds to a deviation of the outer circumference of the developing roller 11 relative to a perfect circle. As described above, the wobble amount B is obtained as an average difference between the actual outer diameter Ln and the average outer diameter L. FIG. 18 is a schematic view showing a model of the wobble amount B according to the first embodiment of the present invention.

As shown in FIG. 18, in the developing roller 11, the actual outer diameter Ln varies with respect to the average outer diameter L. In measuring the wobble amount B, a difference ΔLn between the actual outer diameter Ln and the average outer diameter L was obtained at positions (1 to n) as follows:

$$\Delta Li=|Li-L|\ (n=1 \text{ to } n)$$

The wobble amount B is given by:

$$B=(\Delta L1+\Delta L2+\ldots+\Delta Ln)/n$$

When the wobble amount B becomes larger, a variance in nipping of the developing roller 11 relative to the photosensitive drum 13, i.e., a variance in nipping of the developing roller 11 along the circumferential direction thereof, becomes large. Even when the wobble amount B is large, if the Asker C hardness F is small, it is possible to secure an ability of the developing roller 11 for following the photosensitive drum 13 upon rotating and contacting, thereby decreasing the variance in nipping.

When the variance in nipping of the developing roller 11 along the circumferential direction thereof becomes large, the nip amount tends to decrease periodically, thereby causing the blank portion. Further, the tensional force N corresponds to a pressing force of the developing roller 11 relative to the photosensitive drum 13. Accordingly, when the tensional force N becomes large, it is possible to easily suppress the variance in nipping.

In view of the results and degrees of contribution of the parameters described above, the following equation (2) is established for numerically expressing a level of forming the blank portion.

$$(A\times B\times exp(0.32\times F-16))/N\leqq 11.6 \quad (2)$$

FIG. 14 is the table showing the results of the experiment for determining whether the blank portion was formed in the developing device 3 using the developing roller 11 while the parameters were changed. As shown in FIG. 14, a value of the above equation (2) between 11 and 12 is a threshold value of forming the blank portion. Accordingly, when the developing roller 11 and the tensional force N are adjusted such that the value of the above equation (2) becomes equal to or less than 11.6, the blank portion does not occur.

In the experiment, when the developing roller 11 had the Asker C hardness F of 55 degree, the blank portion did not occur. However, after the developing device 3 was placed for two days under a normal atmosphere (a temperature of 23° C. to 25° C. and a relative humidity of 40% to 50%), a recess portion was generated at the nip portion of the developing roller 11 relative to the photosensitive drum 13, thereby causing a lateral streak on an image.

In general, when the developing roller 11 has a lower hardness, the developing roller 11 presses the photosensitive drum 13 with a lower pressure at a same nip amount, thereby decreasing the tensional force N. That is, when the developing roller 11 has the Asker C hardness of a lower value, the developing roller 11 has a larger nip amount relative to the photosensitive drum 13 at a same tensional force N. Further, when the developing roller 11 has a lower hardness, the elastic layer 11*b* has a lower cross-linking density, thereby making it easy to cause a permanent pressure deformation. Accordingly, when the developing roller 11 has the Asker C hardness F of 55 degree, it is difficult to adjust the nip amount through the tensional force N. Even in a case that the blank portion does not occur, the developing roller 11 tends to have a recess portion.

In the experiment, when the developing roller 11 had the Asker C hardness F of 65 degree, the blank portion did not occur and a recess portion did not occur even when the tensional force was 2.0 N.

As described above, when the developing device 3 is placed for a long period of time under a normal atmosphere, the recess portion tends to occur at the nip portion of the developing roller 11 relative to the photosensitive drum 13. It is found that the crown amount A and the wobble amount B do not have a large influence on the occurrence of the recess portion. It is found that the Asker C hardness and the nip amount, i.e., the tensional force N, have a large influence on the occurrence of the recess portion. That is, when the developing roller 11 has a lower hardness and a larger nip amount, the developing roller 11 tends to deform. Accordingly, when the value of the above equation becomes smaller, the blank portion tends not to occur, but the recess portion tends to occur.

According to the results of the experiment shown in FIG. 14, when the developing roller 11 had the Asker C hardness F of 65 degree, the crown amount A and the wobble amount B became minimum. In this case, even when the tensional force N became 2.0 N, i.e., a maximum level, the blank portion and the recess portion did not occur. From the results, when the developing roller 11 has the Asker C hardness F of 65 to 68 degree, and the value of the above equation (2) is equal to or greater than 0.003 and equal to or less than 11.6, the blank portion and the recess portion do not occur.

When the developing roller 11 has the Asker C hardness F of greater than 83 degree, the surface of the developing roller 11 becomes too hard. Accordingly, when the developing roller 11 contacts with the photosensitive drum 13, the ability of the developing roller 11 for following the surface shape of the photosensitive drum 13 is deteriorated, thereby causing the blank portion. Further, the toner 15 receives excessive damage, thereby lowering reproducibility of dots.

As described above, it is preferred that the value of the above equation (2) becomes smaller, more preferably, equal to zero. In an actual case, it is difficult to make the value of the above equation (2) zero. In the experiment, the developing roller 11 and the tensional force N were not evaluated with the value of the above equation (2) less than 0.0025. Accordingly, although it is preferred that the value of the above equation (2) becomes smaller, more preferably, equal to zero, it is difficult to make the value of the above equation (2) zero. No evaluation was conducted with the value of the above equation (2) less than 0.0025. Accordingly, the lower limit of with the value of the above equation (2) is 0.0025.

It is preferred that the Asker C hardness is between 65 and 83 degree. In this case, the lower limit of the value of the above equation (2) is 0.0030.

With a recent increase in a printing speed, the developing roller 11 rotates at a higher speed. Accordingly, it is difficult to secure the nipping of the developing roller 11 relative to the photosensitive drum 13. The embodiment is effective for an apparatus for printing at a high speed.

In the embodiment, it is arranged such that the developing roller 11 and the photosensitive drum 13 have the tensional force N (N) inbetween with a relationship (3) as follows:

$$(A \times B \times exp(0.32 \times F - 16))/N \leqq 11.6 \quad (3)$$

where A (mm) is the crown amount of the developing roller 11; B (mm) is the wobble amount of the end portion of the developing roller 11; F (degree) is the Asker C hardness of the developing roller 11.

Accordingly, when the outer diameter of the developing roller 11 decreases under an environment of a low temperature and a low humidity, it is possible to secure the nip amount of the developing roller 11 relative to the photosensitive drum 13, thereby preventing the blank portion due to an insufficient nip amount.

Second Embodiment

A second embodiment of the present invention will be explained next. Components in the second embodiment similar to those in the first embodiment are designated with the same reference numerals, and explanations thereof are omitted. Explanations of operations and effects in the second embodiment similar to those in the first embodiment are omitted.

Figure 15:
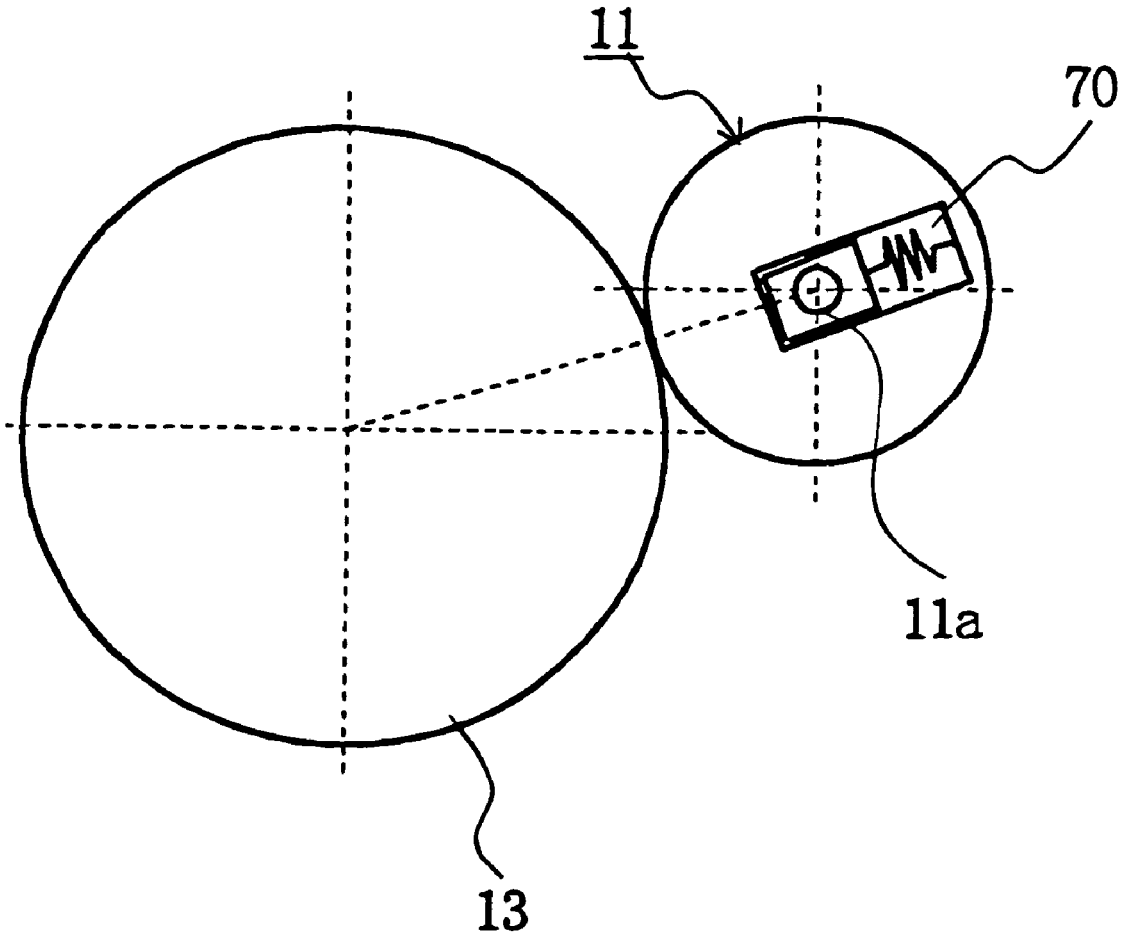
FIG. 15 is a schematic view showing a developing roller and a photosensitive drum according to a second embodiment of the present invention.

FIG. 15 is a schematic view showing the developing roller 11 and the photosensitive drum 13 according to the second embodiment of the present invention.

In the first embodiment, the developing roller 11 and the photosensitive drum 13 are arranged such that the developing roller 11 abuts against the photosensitive drum 13 while the distance between the rotational shafts thereof is fixed constant. In the second embodiment, as shown in FIG. 15, the developing roller 11 is urged to abut against the photosensitive drum 13. More specifically, a spring 70 is provided for urging the end portions of the shaft metal 11*a* of the developing roller 11 toward the photosensitive drum 13. The spring 70 urges the developing roller 11 in a direction same as the line between the rotational shafts of the developing roller 11 and the photosensitive drum 13.

In the embodiment, the spring 70 has an urging force of 1.0 to 2.0 kg, so that the tensional force N becomes substantially the same as that in the first embodiment.

An experiment was conducted for determining whether the blank portion was formed in the developing device 3 with the developing roller 11 while the various parameters were changed. Evaluation results of the experiment and a relationship with respect to the value of the equation (2) will be explained next.

FIG. 16 is a table showing the evaluation result according to the second embodiment of the present invention. In the experiment, it was determined whether the blank portion was formed with a method similar to that in the first embodiment.

As shown in FIG. 16, similar to the first embodiment, the value of the equation (2) between 11 and 12 is a threshold value of forming the blank portion. Accordingly, even through the developing roller 11 is urged against the photosensitive drum 13, when it is arranged such that the value of the equation (2) becomes less than 11.6, the blank portion does not occur.

In the experiment, similar to the first embodiment, when the developing roller 11 had the Asker C hardness F of 55 degree, the recess portion was generated at the nip portion of the developing roller 11 relative to the photosensitive drum 13.

In the embodiment, it was arranged such that the developing roller 11 and the photosensitive drum 13 have the tensional force N (N) inbetween with a relationship (4) as follows:

$$(A \times B \times exp(0.32 \times F - 16))/N \leqq 11.6 \quad (4)$$

where A (mm) is the crown amount of the developing roller 11; B (mm) is the wobble amount of the end portion of the developing roller 11; F (degree) is the Asker C hardness of the developing roller 11.

Accordingly, even through the developing roller 11 is urged against the photosensitive drum 13, when the outer diameter of the developing roller 11 decreases under an environment of a low temperature and a low humidity, it is possible to secure the nip amount of the developing roller 11 relative to the photosensitive drum 13, thereby preventing the blank portion due to an insufficient nip amount.

In the first and second embodiments, the present invention is applied to the image forming apparatus of the LED type having the single developing device, and may be applicable to an image forming apparatus having a plurality of developing devices.

The disclosure of Japanese Patent Application No. 2007-140706, filed on May 28, 2007, is incorporated in the application by reference.

While the invention has been explained with reference to the specific embodiments of the invention, the explanation is illustrative and the invention is limited only by the appended claims.

What is claimed is:

1. A developing device comprising:

an image supporting member to be driven by a drive motor to rotate in a first direction; and a developer supporting member to be driven by the drive motor to rotate in a second direction opposite to the first direction, said developer supporting member abutting against the image supporting member for developing a static latent image on the image supporting member, said developer supporting member having the Asker C hardness of 65 degree to 83 degree, said developer supporting member being arranged so that, in a state that a predetermined film member is disposed between the image supporting member and the developer supporting member at a position away from an end portion of the developer supporting member by 10 mm, the film member is extended with a tensional force N (N) in a tangential direction relative to the first direction and the second direction to slide against the image supporting member and the developer supporting member when the image supporting member and the developer supporting member rotate, said tensional force N having a relationship as follows:

$$0.003(\mathrm{mm}^2/N) \leqq (A \times B \times \exp(0.32 \times F - 16))/N \leqq 11.6 \ (\mathrm{mm}^2/N)$$

wherein A (mm) is a difference between an outer diameter of a center portion of the developer supporting member and an outer diameter of an end portion of the developer supporting member and is greater than zero (A>0); B (mm) is a wobble amount of the end portion of the developer supporting member; and F (degree) is an Asker C hardness of the developer supporting member.

2. The developing device according to claim 1, wherein said developer supporting member has the outer diameter at the center portion thereof greater than the outer diameter at the end portion thereof by 0.01 mm to 0.1 mm.

3. The developing device according to claim 1, wherein said developer supporting member is arranged so that the tensional force N can be adjusted through a distance between a rotational shaft of the developer supporting member and a rotational shaft of the image supporting member.

4. The developing device according to claim 1, further comprising an urging member for urging the developer supporting member toward the image supporting member so that the tensional force N can be adjusted.

5. The developing device according to claim 1, wherein said developer supporting member is arranged so that, in a state that the film member having a surface with a ten-point average roughness equal to or less than 0.5 μm is disposed between the image supporting member and the developer supporting member, the film member is extended with the tensional force N (N).

6. The developing device according to claim 1, wherein said developer supporting member is arranged so that, in a state that the film member formed of polypropylene is disposed between the image supporting member and the developer supporting member, the film member is extended with the tensional force N (N).

7. The developing device according to claim 1, wherein said developer supporting member is arranged so that the film member is extended with the tensional force N measured with an specific interval for a specific period of time.

8. An image forming apparatus comprising:

a sheet supply unit for supplying a recording medium;

a developing device for forming a developer image;

a transfer unit for transferring the developer image to the recording medium;

a drive motor; and a fixing unit for fixing the developer image on the recording medium, wherein said developing device includes an image supporting member to be driven by the drive motor to rotate in a first direction; and a developer supporting member to be driven by the drive motor to rotate in a second direction opposite to the first direction, said developer supporting member abutting against the image supporting member for developing a static latent image on the image supporting member, said developer supporting member having the asker C hardness of 65 degree to 83 degree, said developer supporting member being arranged so that, in a state that a predetermined film member is-disposed between the image supporting member and the developer supporting member at a position away from an end portion of the developer supporting member by 10 mm, the film member is extended with a tensional force N (N) in a tangential direction relative to the first direction and the second direction to slide against the image supporting member and the developer supporting member when the image supporting member and the developer supporting member rotate, said tensional force N having a relationship as follows:

$$0.003(\mathrm{mm}^2/N) \leqq (A \times B \times \exp(0.32 \times F - 16))/N \leqq 11.6 \ (\mathrm{mm}^2/N)$$

wherein A (mm) is a difference between an outer diameter of a center portion of the developer supporting member and an outer diameter of an end portion of the developer supporting member and is greater than zero (A>0); B (mm) is a wobble amount of the end portion of the developer supporting member; and F (degree) is an Asker C hardness of the developer supporting member.

9. The image forming apparatus according to claim 8, wherein said developer supporting member has the outer diameter at the center portion thereof greater than the outer diameter at the end portion thereof by 0.01 mm to 0.1 mm.

10. The image forming apparatus according to claim 8, wherein said developer supporting member is arranged so that, in a state that the film member having a surface with a ten-point average roughness equal to or less than 0.5 μm is disposed between the image supporting member and the developer supporting member, the film member is extended with the tensional force N (N).

11. The image forming apparatus according to claim 8, wherein said developer supporting member is arranged so that, in a state that the film member formed of polypropylene is disposed between the image supporting member and the developer supporting member, the film member is extended with the tensional force N (N).

12. The image forming apparatus according to claim 8, wherein said developer supporting member is arranged so that the film member is extended with the tensional force N measured with an specific interval for a specific period of time.

* * * * *